US011291297B2

(12) United States Patent
Chen

(10) Patent No.: US 11,291,297 B2
(45) Date of Patent: Apr. 5, 2022

(54) PORTABLE AND ADJUSTABLE PICNIC TABLE

(71) Applicant: Inno-Sports Co., Ltd., Xiamen (CN)

(72) Inventor: Renhua Chen, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 0 days.

(21) Appl. No.: 17/038,369

(22) Filed: Sep. 30, 2020

(65) Prior Publication Data

US 2021/0106132 A1 Apr. 15, 2021

(30) Foreign Application Priority Data

Oct. 9, 2019 (CN) ..... 201921680779.0
Apr. 30, 2020 (CN) ..... 202020712844.X

(51) Int. Cl.

| | |
|---|---|
| ***A47B 3/14*** | (2006.01) |
| ***A47B 3/08*** | (2006.01) |
| ***A47B 9/20*** | (2006.01) |
| ***A47B 83/02*** | (2006.01) |
| ***A47B 37/04*** | (2006.01) |

(52) U.S. Cl.

CPC ..... *A47B 3/14* (2013.01); *A47B 3/08* (2013.01); *A47B 9/20* (2013.01); *A47B 37/04* (2013.01); *A47B 83/024* (2017.08)

(58) Field of Classification Search

CPC ... A47B 3/14; A47B 2003/145; A47B 83/021; A47B 83/0213

USPC ..... 297/158.4, 158.3

See application file for complete search history.

(56) References Cited

U.S. PATENT DOCUMENTS

| | | | | |
|---|---|---|---|---|
| 2,752,987 A * | 7/1956 | Smithers | ..... | A47B 3/14 297/158.4 |
| 2,875,007 A | 2/1959 | Fox | | |
| 3,027,209 A | 3/1962 | Nielsen | | |
| 3,276,815 A | 10/1966 | Cardy | | |
| 3,410,232 A | 11/1968 | Bills | | |
| 3,574,393 A | 4/1971 | Hughes | | |
| 4,330,151 A * | 5/1982 | Healey | ..... | A47B 9/00 297/158.3 |
| 4,974,871 A | 12/1990 | Mao | | |
| 5,414,895 A | 5/1995 | Kazmark, Jr. | | |
| 5,499,426 A | 3/1996 | Hsieh | | |

(Continued)

FOREIGN PATENT DOCUMENTS

| | | | | |
|---|---|---|---|---|
| CA | 2413826 A1 * | 6/2004 | ..... | A47B 3/14 |
| FR | 2807632 | 10/2001 | | |

*Primary Examiner* — Jose V Chen

(74) *Attorney, Agent, or Firm* — Morgan, Lewis & Bockius LLP

(57) ABSTRACT

A picnic table includes a table panel, one or more bench panels and a supporting frame to support the table and bench panels. The supporting frame includes first and second supporting assemblies, each including a table support and one or more bench supports. The supporting frame further includes a table frame and one or more bench frames. The table frame rotatably connects the table support of each of the first and second supporting assemblies with the table panel. Each bench frame rotatably connects a bench support of each of the first and second supporting assemblies with a bench panel. The table support of each of the first and second supporting assemblies is adjustable in length. Adjusting the length of the table support changes the height of the table panel with respect to the one or more bench panels.

16 Claims, 13 Drawing Sheets

(56) References Cited

U.S. PATENT DOCUMENTS

| | | | | |
|---|---|---|---|---|
| 5,921,623 | A | 7/1999 | Nye | |
| 6,047,442 | A | 4/2000 | Workman | |
| 6,186,590 | B1 * | 2/2001 | Tseng | A47B 3/14 297/108 |
| 6,247,203 | B1 | 6/2001 | Kuo | |
| 6,347,831 | B1 * | 2/2002 | Nye | A47B 3/14 297/118 |
| 6,572,203 | B1 | 6/2003 | Cheng | |
| 6,644,734 | B1 * | 11/2003 | Tseng | A47B 3/14 297/158.4 |
| 6,843,183 | B2 | 1/2005 | Strong | |
| 7,410,194 | B2 | 8/2008 | Chen | |
| 7,735,915 | B2 * | 6/2010 | Nye | A47B 3/14 297/158.4 |
| 8,474,098 | B1 | 7/2013 | Yang | |
| 9,738,295 | B1 | 8/2017 | Horowitz | |
| 10,159,334 | B1 | 12/2018 | Wang | |
| 10,206,496 | B1 | 2/2019 | Miller | |
| 10,470,561 | B2 | 11/2019 | Clegg et al. | |
| D895,345 | S | 9/2020 | Leng | |
| 10,806,247 | B1 * | 10/2020 | Chen | A47B 13/088 |
| 10,806,248 | B1 * | 10/2020 | Chen | A47B 3/0812 |
| 11,026,505 | B2 * | 6/2021 | Leng | A47B 3/087 |
| 2004/0070235 | A1 | 4/2004 | Gregory | |
| 2004/0195869 | A1 | 10/2004 | Zhurong | |
| 2004/0227382 | A1 * | 11/2004 | Lin | A47B 3/14 297/158.4 |
| 2006/0181114 | A1 | 8/2006 | Nye | |
| 2008/0018142 | A1 | 1/2008 | Yul | |
| 2012/0175919 | A1 * | 7/2012 | Kane | A47B 37/04 297/158.3 |
| 2021/0007474 | A1 | 1/2021 | Nye | |
| 2021/0106132 | A1 | 4/2021 | Chen | |
| 2021/0112967 | A1 | 4/2021 | Leng | |
| 2021/0112968 | A1 | 4/2021 | Ponomar | |
| 2021/0169214 | A1 | 6/2021 | Choi | |
| 2021/0177135 | A1 | 6/2021 | Leng | |
| 2021/0274930 | A1 | 9/2021 | Choi | |

* cited by examiner

PORTABLE AND ADJUSTABLE PICNIC TABLE

CROSS-REFERENCE TO RELATED APPLICATIONS

The present application claims priority to Chinese Utility Model Applications CN 201921680779.0 filed Oct. 9, 2019 and CN 2020020712844.X filed Apr. 30, 2020. The disclosure of each application is incorporated herein for all purposes by reference in its entirety.

FIELD OF THE INVENTION

The present invention generally relates to tables and, in particular, to portable and adjustable picnic tables.

BACKGROUND

Picnicking and camping become more and more popular these days. However, existing picnic tables are usually too bulky or heavy for people to carry around. In addition, most exiting picnic tables are not adjustable in height, and do not fully meet the needs of different people.

Given the current state of the art, there remains a need for portable and adjustable picnic tables that address the above-mentioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides portable and adjustable picnic tables that are adjustable in height and foldable for convenient storage and transportation.

In various exemplary embodiments, the present disclosure provides a picnic table including a table panel and one or more bench panels. The picnic table also includes first and second supporting assemblies, each operable between a use position and a storage position. When in the use position, the first supporting assembly is disposed at a first side of the picnic table and the second supporting assembly is disposed at a second side of the picnic table. Each of the first and second supporting assemblies includes a table support and one or more bench supports. The picnic table further includes a table frame and one or more bench frames. The table frame is disposed at a bottom side of the table panel and configured to connect the table supports of the first and second supporting assemblies with the table panel such that the table support of each of the first and second supporting assemblies is rotatable with respect to the table panel. Each of the one or more bench frames is disposed at a bottom side of a corresponding bench panel in the one or more bench panels and configured to connect a respective bench support in the one or more bench supports of the first supporting assembly and a respective bench support in the one or more bench supports of the second supporting assembly with the corresponding bench panel such that the respective bench supporting assembly of each of the first and second supporting assemblies is rotatable with respect to the corresponding bench panel. The table support of each of the first and second supporting assemblies includes one or more adjustable supports each having an adjustable length. As such, when each of the first and second supporting assemblies is in the use position, adjusting collectively the lengths of the one or more adjustable supports of the table supports of the first and second supporting assemblies changes a height of the table panel with respect to the one or more bench panels.

In some exemplary embodiments, each of the first and second supporting assemblies further includes a crossbar connecting the table support and the one or more bench supports.

In an exemplary embodiment, the crossbar is configured to be placed on a ground when the picnic table is in use.

In some exemplary embodiments, each of the one or more adjustable supports of the table support includes an inner bar and an outer bar telescopically coupled with each other.

In an exemplary embodiment, the table support further includes an adjustment mechanism coupled with the one or more adjustable supports and configured to control relative movement of the inner and outer bars of each of the one or more adjustable supports.

In another exemplary embodiment, each of the one or more adjustable supports includes a locking/unlocking mechanism configured to control relative movement of the inner and outer bars of the respective adjustable support.

In some exemplary embodiments, the table frame includes a first table side bar coupled with a first side of the table panel, a second table side bar coupled with a second side of the table panel, and a table connecting bar corresponding to each respective supporting assembly in the first and second supporting assemblies. The table connecting bar includes a first end portion pivotally connected with the first table side bar, a second end portion pivotally connected with the second table side bar, and a middle portion between the first and second end portions. The one or more adjustable supports of the respective table support are connected with the table connecting bar.

In an exemplary embodiment, the table connecting bar is curved or bended, with the first and second end portions aligned with each other and the middle portion being offset with respect to the first and second end portions.

In some exemplary embodiments, corresponding to each respective supporting assembly in the first and second supporting assemblies, the table frame further includes a rail, a slider and a link. The rail is disposed between the first and second table side bars and extended in a direction substantially the same as the first and second table side bars. The slider is slidably coupled with the rail and includes a control mechanism to lock or unlock the slider with respect to the rail. The link has a first end portion pivotally coupled with the slider and a second end portion pivotally coupled with the one or more adjustable supports.

In an exemplary embodiment, corresponding to each respective supporting assembly in the first and second supporting assemblies, the table frame further includes a reinforcement bar having a first end portion connected with the first table side bar and a second end portion connected with the second table side bar. The rail is connected with the middle portion of the connecting bar and a middle portion of the reinforcement bar.

In another exemplary embodiment, the rail corresponding to the first supporting assembly and the rail corresponding to the second supporting assembly are integrally formed as a unitary piece.

In some exemplary embodiments, each of the one or more bench frames includes a first bench side bar coupled with a first side of the corresponding bench panel and a second bench side bar coupled with a second side of the bench panel. Each of the one or more bench frames further includes a bench connecting bar corresponding to each respective supporting assembly in the first and second supporting assemblies. The bench connecting bar includes a first end portion pivotally connected with the first bench side bar and a second end portion pivotally connected with the second bench side bar. The bench connecting bar is aligned with the first and second end portions of the table connecting bar, and the respective bench support in the one or more bench supports of the respective table support is connected with the bench connecting bar.

In some exemplary embodiments, the height of the table panel is adjustable between a first position at which the table panel is positioned higher than the one or more bench panels and a second position at which the table panel is positioned at a level substantially the same as the one or more bench panels.

In various exemplary embodiments, the present disclosure provides a supporting frame including first and second supporting assemblies, a table frame, and one or more bench frames. Each of the first and second supporting assemblies includes a crossbar, a table support connected with the crossbar, and one or more bench supports each connected or formed with the crossbar. The table frame is configured to connect the table supports of the first and second supporting assemblies with a table panel such that the table support of each of the first and second supporting assemblies is rotatable with respect to the table panel. Each of the one or more bench frames is configured to connect a respective bench support in the one or more bench supports of the first supporting assembly and a respective bench support in the one or more bench supports of the second supporting assembly with a corresponding bench panel in one or more bench panels such that the respective bench supporting assembly of each of the first and second supporting assemblies is rotatable with respect to the corresponding bench panel. The table support of each of the first and second supporting assemblies includes one or more adjustable supports each having an adjustable length. As such, when each of the first and second supporting assemblies is in a use position, adjusting collectively the lengths of the one or more adjustable supports of the table supports of the first and second supporting assemblies changes a height of the table panel with respect to the one or more bench panels.

In an exemplary embodiment, the table support further includes an adjustment mechanism coupled with the one or more adjustable supports to control relative movement of the inner and outer bars of the one or more adjustable supports.

In another exemplary embodiment, each of the one or more adjustable supports includes a locking/unlocking mechanism configured to control relative movement of the inner and outer bars of the respective adjustable support.

In some exemplary embodiments, the table frame includes a first table side bar coupled with a first side of the table panel, a second table side bar coupled with a second side of the table panel, and a table connecting bar corresponding to each respective supporting assembly in the first and second supporting assemblies. The table connecting bar includes a first end portion pivotally connected with the first table side bar, a second end portion pivotally connected with the second table side bar, and a middle portion between the first and second end portions. The one or more adjustable supports of the respective table support are connected with the table connecting bar.

In an exemplary embodiment, the table connecting bar is curved or bended, wherein the first and second end portions are aligned with each other, and the middle portion is offset with respect to the first and second end portions.

In some exemplary embodiments, corresponding to each respective supporting assembly in the first and second supporting assemblies, the table frame further includes a rail, a slider and a link. The rail is disposed between the first and second table side bars and extended in a direction substantially the same as the first and second table side bars. The slider is slidably coupled with the rail and includes a control mechanism to lock or unlock the slider with respect to the rail. The link has a first end portion pivotally coupled with the slider and a second end portion pivotally coupled with the one or more adjustable supports.

In an exemplary embodiment, corresponding to each respective supporting assembly in the first and second supporting assemblies, the table frame further includes a reinforcement bar having a first end portion connected with the first table side bar and a second end portion connected with the second table side bar, wherein the rail is connected with the middle portion of the table connecting bar and a middle portion of the reinforcement bar.

In various exemplary embodiments, the present disclosure provides a supporting assembly including a crossbar, a table support and one or more bench supports. The crossbar is configured to be placed on a ground and serving as a base. The table support is configured to support a table panel and has a lower end portion fixedly connected or formed with the crossbar. Each of the one or more bench supports is disposed at a side of the table support to support a bench panel and has a lower end portion fixedly connected or formed with the crossbar. The table support includes one or more adjustable supports each including an inner bar and an outer bar telescopically coupled with each other, thereby allowing adjustment of a height of the table panel with respect to the one or more bench panels. In an exemplary embodiment, each of the one or more adjustable supports includes a locking/unlocking mechanism to control relative movement of the inner and outer bars of the respective adjustable support. In another exemplary embodiment, the table support further includes an adjustment mechanism coupled with the one or more adjustable supports to control relative movement of the inner and outer bars of the one or more adjustable supports.

The supporting assemblies, supporting frames and picnic tables of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1:
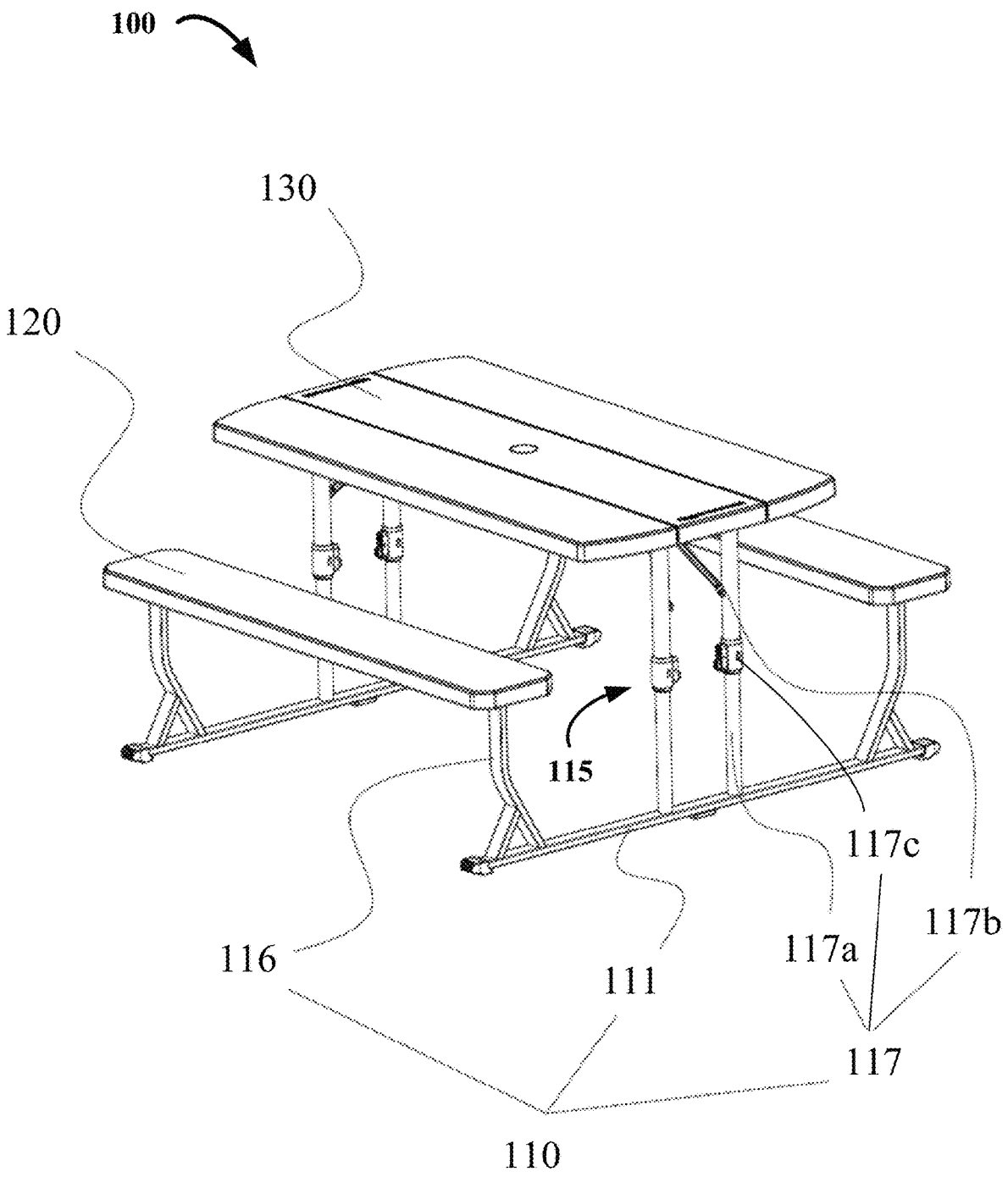
FIG. 1 is a top perspective view illustrating an exemplary picnic table in an unfolded state in accordance with exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present disclosure are described in the context of picnic tables. A picnic table generally includes a table panel, one or more bench panels and a supporting frame to support the table and bench panels. A supporting frame generally includes one or more supporting assemblies, each having a table support rotatably coupled with the table panel and one or more bench supports rotatably coupled with the one or more bench supports. The table support is adjustable in length. As such, the height of the table panel can be adjusted, by adjusting the length of the table support, to meet the needs of various end users. In addition, the table and bench panels can be aligned with each other (e.g., on the same plane) with the supporting frame folded onto the table and bench panels. In such a folded state, the picnic table is compact and has a general panel-like shape, making it easy and convenient for storage and transportation.

The table and bench panels of the picnic tables disclosed herein can be of various shapes including but not limited to a square shape, a round shape or a rectangular shape, and can be made of various materials including but not limited to metals, plastics and woods. In some exemplary embodiments, the table panel, the bench panel or both are made of plastics by injection molding, blow molding or any other suitable processes. The supporting frame of the present disclosure can be made of various materials including but not limited to metals (e.g., iron, steel, and aluminum) and plastics.

Figure 2:
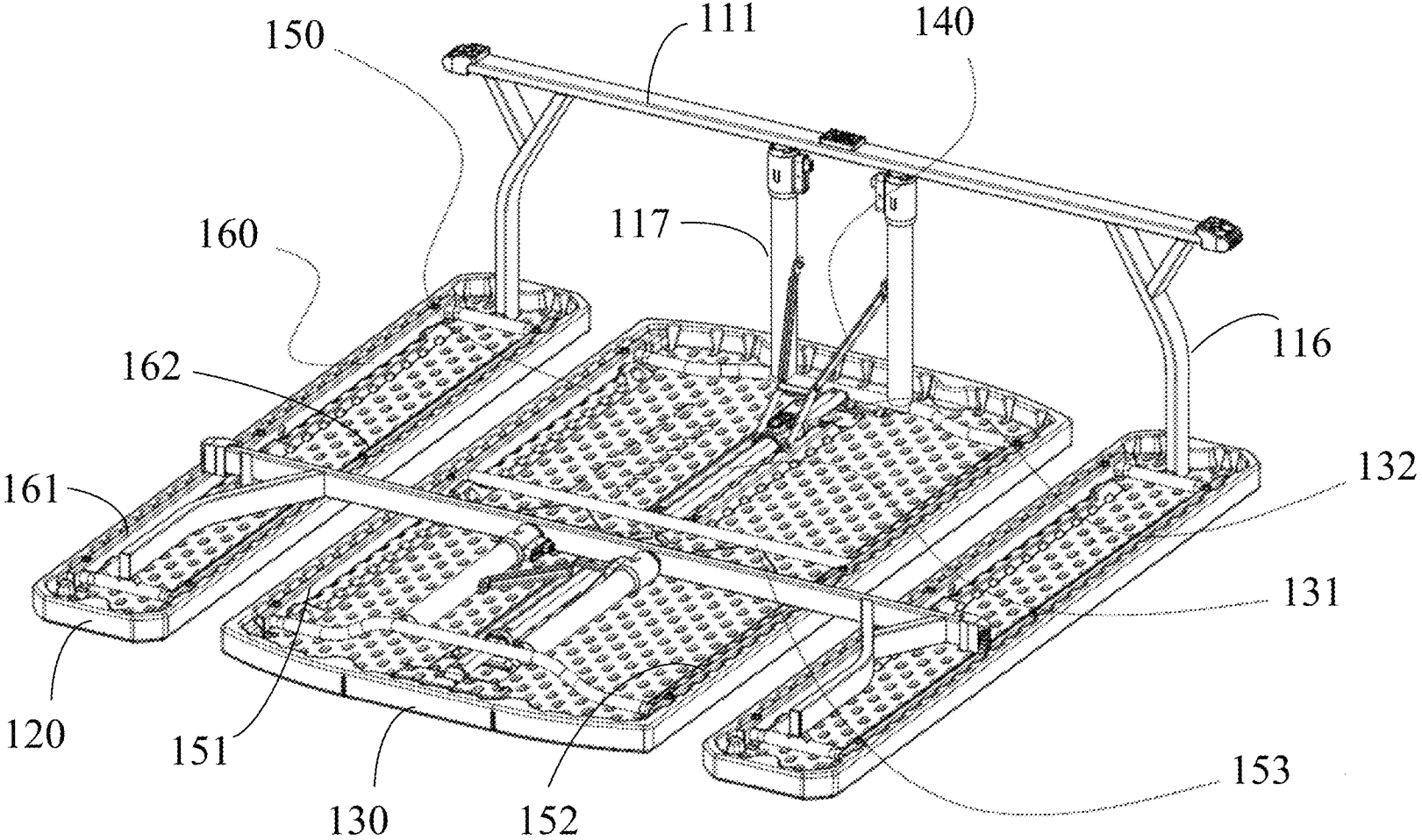
FIG. 2 is a bottom perspective view illustrating an exemplary picnic table in a partially folded state in accordance with exemplary embodiments of the present disclosure.

Referring now to FIGS. 1 and 2, there is depicted an exemplary picnic table in accordance with some embodiments of the present disclosure. As shown, picnic table 100 includes a table panel such as table panel 130 and one or more bench panels such as bench panel 120.

Picnic table 100 also includes one or more supporting assemblies such as supporting assembly 110 to support the table and bench panels. By way of example, FIGS. 1 and 2 illustrates two supporting assemblies, one at a first side and one at a second side of the picnic table when in use. The supporting assemblies can be the same as or different from each other. In some exemplary embodiments, supporting assembly 110 includes a table support such as table support 115 to support the table panel and one or more bench supports such as bench support 116 to support the one or more bench panels. For instance, in the illustrated embodiment, supporting assembly 110 includes two bench supports 116, each supporting a corresponding bench panel 120. The supporting assembly of the present disclosure can be made of various materials including but not limited to metals (e.g., iron, steel, and aluminum) and plastics.

Picnic table 100 further includes a table frame such as table frame 150 and one or more bench frames such as bench frame 160. Table frame 150 is disposed at a bottom side of table panel 130 and configured to rotatably connect the table support of each supporting assembly 110 with the table panel. Each bench frame 160 is disposed at a bottom side of a corresponding bench panel and configured to rotatably connect respective bench support 116 of each supporting assembly 110 with the corresponding bench panel. The table and bench frames, together with the one or more supporting assemblies, are collectively referred to herein as a supporting frame.

Of each supporting assembly 110, table support 115 is configured to be an adjustable assembly or to include an adjustable assembly so that the length of the table support and thus the height of the table panel can be adjusted. An adjustable assembly generally includes one, two, three or more than three adjustable supports. For instance, as an example, FIG. 1 illustrates table support (or adjustable assembly) 115 having two adjustable supports 117 that are spaced apart and substantially parallel to each other. Each adjustable support 117 includes an inner bar such as inner bar 117*a* and an outer tubular bar such as outer tubular bar 117*b*, and telescopically coupled with the outer tubular bar. The inner bar can be tubular or non-tubular. Each adjustable support 117 also includes a locking/unlocking mechanism such as locking/unlocking mechanism 117*c* configured to control relative movement of the inner and outer bars of the respective adjustable support. Examples of adjustable supports are disclosed in U.S. patent application Ser. Nos. 15/400,861, 15/931,925 and 17/000,661, the disclosure of each application is incorporated herein for all purposes by reference in its entirety.

In some exemplary embodiments, the table support and the one or more bench supports are connected with each other by a crossbar such as crossbar 111. For instance, in an exemplary embodiment, the lower end of the table support (e.g., the distal end of inner bar 117*a* of adjustable support 117) and the lower end of the bench support are connected or formed with the crossbar. In some exemplary embodiments, the one or more bench supports are integrally or monolithically formed with the crossbar. In an exemplary embodiment, the crossbar is configured to be placed on a ground, e.g., serving as a base, when the picnic table is in use.

Figure 4:
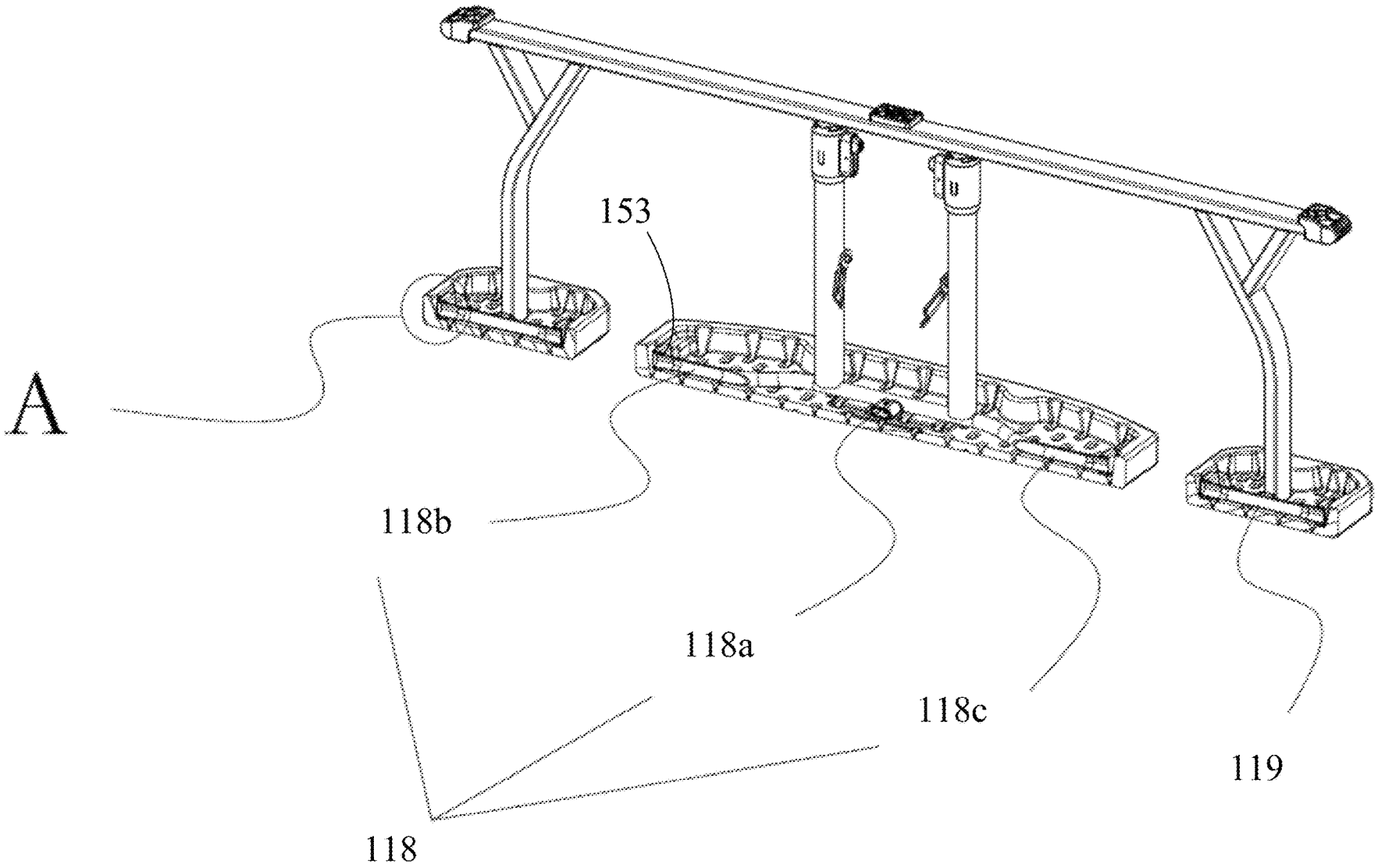
FIG. 4 is a second cutout view of FIG. 2.
Figure 5:
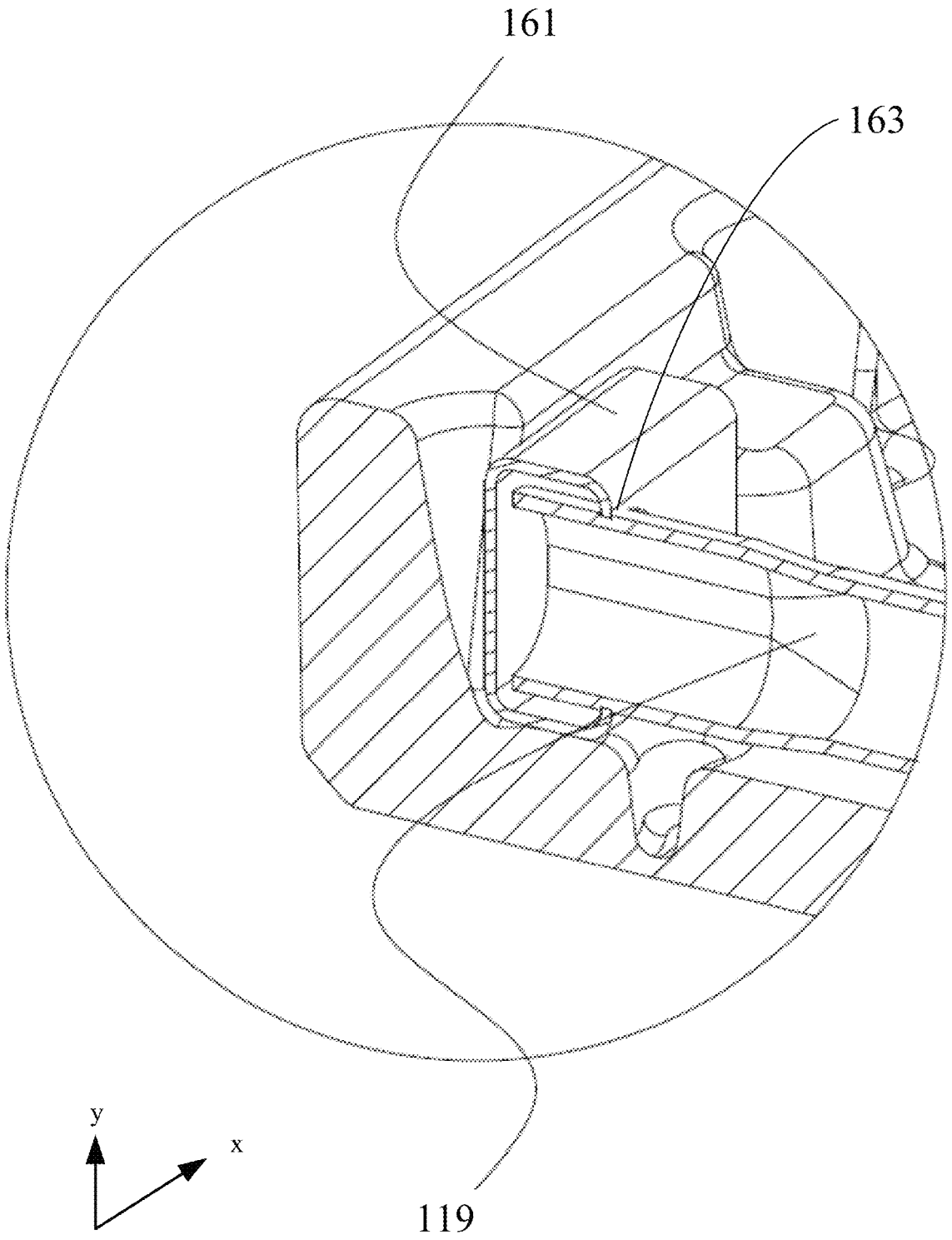
FIG. 5 is an enlarged view taken along circle A of FIG. 4.

Referring to FIGS. 2 and 4, table frame 150 is disposed at a bottom side of table panel 130 and configured to rotatably connect the table support of each supporting assembly 110 with the table panel. For instance, in some exemplary embodiments, table frame 150 includes a first table side bar such as side bar 151 coupled with a first side of the table panel and a second side bar such as side bar 152 coupled with a second side of the table panel. Corresponding to each supporting assembly, table frame 150 also includes a table connecting bar such as connecting bar 118. For instance, table frame 150 in the illustrated embodiment includes two table connecting bars, one for each supporting assembly 110. Connecting bar 118 has first end portion 118*b* pivotally connected with the first table side bar, second end portion 118*c* pivotally connected with the second table side bar, and middle portion 118*a* between the first and second end portions.

The table support (e.g., the one or more adjustable supports 117 of the table support) is connected with the table connecting bar, for instance, connected with the middle portion of the table connecting bar. Since the table connecting bar is pivotally connected with the first and second table side bars, the table support is thus rotatable with respect to the table panel. In an exemplary embodiment, the table support includes the table connecting bar, e.g., the table connecting bar being a component of the table support instead of a component of the table frame.

In some exemplary embodiments, the table connecting bar is curved or bended such that the first and second end portions are aligned with each other and the middle portion is offset with respect to the first and second end portions. This configuration helps to prevent disengagement of the table connecting bar from the table side bars and to stabilize the picnic table when in use.

In some exemplary embodiments, one or each of the first and second table side bars is formed with a hole such as hole 153 to couple with the first or second end portion of table connecting bar 118. The hole of the table side bar and the end portion of the table connecting bar are configured such that the hole and end portion are loosely coupled with each other when the table support is folded onto the table panel and are tightly coupled with each other when the table support is unfolded and supports the table panel. This can be achieved by having a circular hole coupled with an end portion of an oval or oblong cross-section, by having an oval or oblong hole coupled with a circular end portion, by having an oval or oblong hole coupled with an end portion of an oval or oblong cross-section, or the like. This configuration makes it easy to fold and unfold the table support and thus the supporting assembly, and helps to prevent disengagement of the table connecting bar from the table side bars and stabilize the picnic table when in use.

Figure 3:
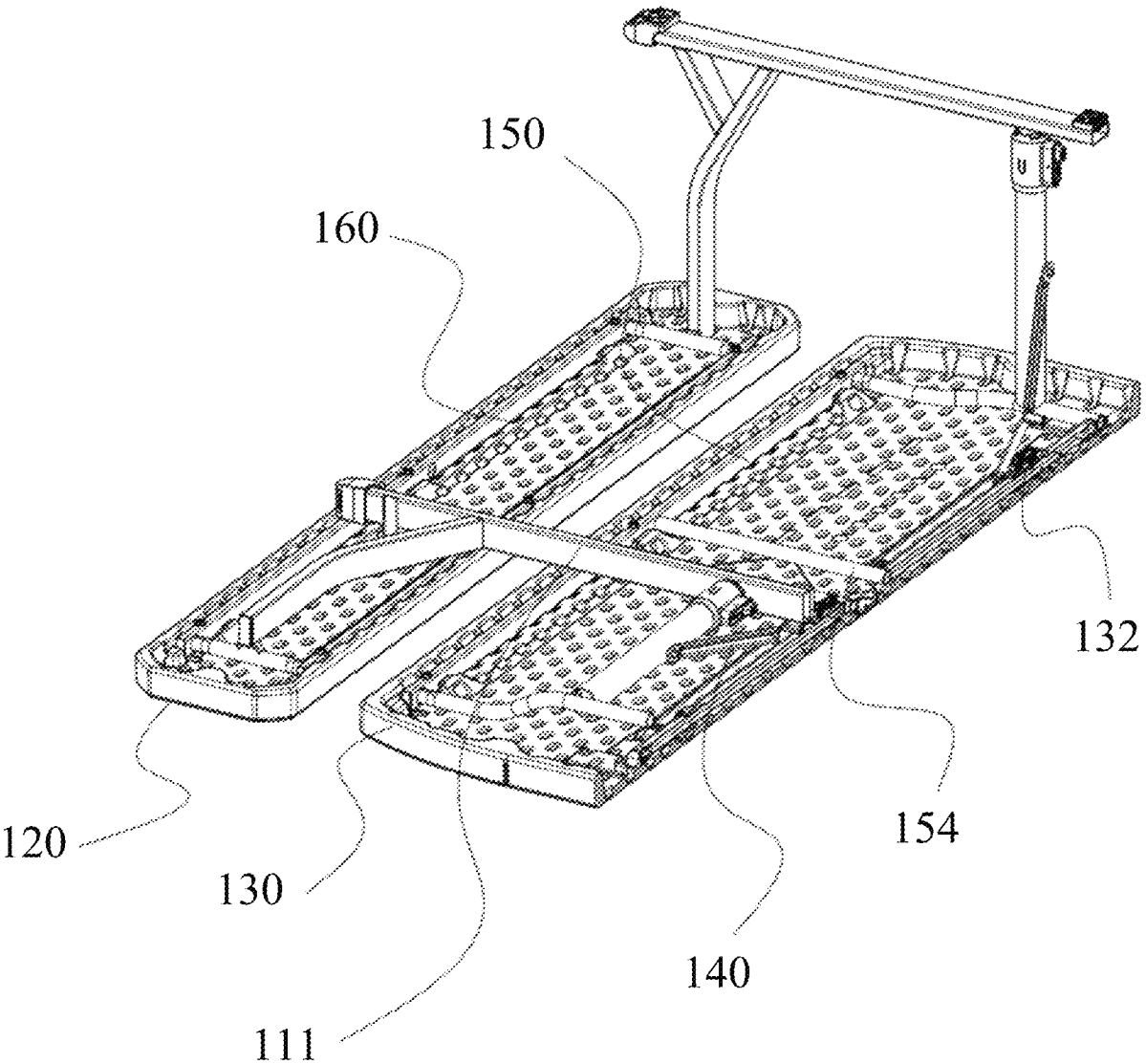
FIG. 3 is a first cutout view of FIG. 2.

Referring to FIGS. 2 and 3, in some exemplary embodiments, corresponding to each supporting assembly, the table frame includes a rail, a slider and a link configured to guide the rotation of the table support (and thus the folding and unfolding of the supporting assembly), and/or to hold and enhance the stability of the supporting assembly when in use. For instance, in an exemplary embodiment, corresponding to each supporting assembly 110, table frame 150 includes rail 131, slider 132 and link 140. Rail 131 is disposed between the first and second table side bars and extended in a direction substantially the same as the first and second table side bars. Slider 132 is slidably coupled with the rail and includes a control mechanism to lock or unlock the slider with respect to the rail, which includes a hole, a slot, a groove or the like to couple with the control mechanism. Examples of sliders are disclosed in U.S. patent application Ser. Nos. 16/838,944 and 16/838,947, the disclosure of each application is incorporated herein for all purposes by reference in its entirety. Link 140 is configured to couple the table support with the slider. It can have various configurations and be made of various materials. In some exemplary embodiments, it has a first end portion pivotally coupled with the slider and a second end portion pivotally coupled with the one or more adjustable supports.

In some exemplary embodiments, corresponding to each supporting assembly, the table frame further includes a reinforcement bar to enhance the strength and the stability of the table panel. For instance, in an exemplary embodiment, corresponding to each supporting assembly 110, table frame 150 includes reinforcement bar 154 having a first end portion connected with the first table side bar and a second end portion connected with the second table side bar.

In an exemplary embodiment, rail 131 has one end portion connected with the middle portion of the connecting bar and another portion connected with a middle portion of the reinforcement bar. In another exemplary embodiment, the rails corresponding to the supporting assemblies are integrally and monolithically formed as a unitary piece.

Referring to FIGS. 2-5, each bench frame 160 is disposed at a bottom side of a corresponding bench panel and configured to rotatably connect respective bench support 116. For instance, in some exemplary embodiments, bench frame 160 includes a first bench side bar such as side bar 161 coupled with a first side of the bench panel and a second side bar such as side bar 162 coupled with a second side of the bench panel. Corresponding to each supporting assembly, bench frame 160 also includes a bench connecting bar such as connecting bar 119. For instance, bench frame 160 in the illustrated embodiment includes two bench connecting bars, one for each supporting assembly 110. Connecting bar 119 has a first end portion pivotally connected with the first bench side bar and a second end portion pivotally connected with the second bench side bar.

The bench support is connected with the bench connecting bar, and is thus rotatable with respect to the bench panel. In an exemplary embodiment, the bench support includes the bench connecting bar, e.g., the bench connecting bar being a component of the bench support instead of a component of the bench frame. In an exemplary embodiment, the bench connecting bar is a straight bar and aligned with the first and second end portions of the table connecting bar.

In some exemplary embodiments, one or each of the first and second bench side bars is formed with a hole such as hole 163 to couple with the first or second end portion of bench connecting bar 119. The hole of the bench side bar and the end portion of the bench connecting bar are configured such that the hole and end portion are loosely coupled with each other when the bench support is folded onto the bench panel and are tightly coupled with each other when the bench support is unfolded and supports the bench panel. This can be achieved by having a circular hole coupled with an end portion of an oval or oblong cross-section, by having an oval or oblong hole coupled with a circular end portion, by having an oval or oblong hole coupled with an end portion of an oval or oblong cross-section, or the like. This configuration makes it easy to fold and unfold the bench support and thus the supporting assembly. In addition, this configuration helps to prevent disengagement of the bench connecting bar from the bench side bars and to stabilize the picnic table when in use.

Referring back to FIGS. 1 and 2, with the table and bench frames disclosed herein, each supporting assembly 110 is operable between a use position and a storage position. For instance, FIG. 1 illustrates both supporting assemblies in the use position, and FIG. 2 illustrates one supporting assembly (the upper one in the figure) in the use position and another supporting assembly (the lower one in the figure) in the storage position. When both of the supporting assemblies are in the use position, one can change the height of the table panel by adjusting collectively the lengths of adjustable supports 117 of table supports 115 of the supporting assemblies. In some exemplary embodiments, the height of the table panel is adjustable between a first position at which the table panel is positioned higher than the one or more bench panels and a second position at which the table panel is positioned at a level substantially the same as the one or more bench panels. In an exemplary embodiment, there exists at least one intermediate position between the first and second positions. When the table panel is aligned with the one or more bench panels, the supporting assembly can be folded onto the table and bench panels, thereby making the picnic table compact and convenient for storage and transportation.

Figure 6:
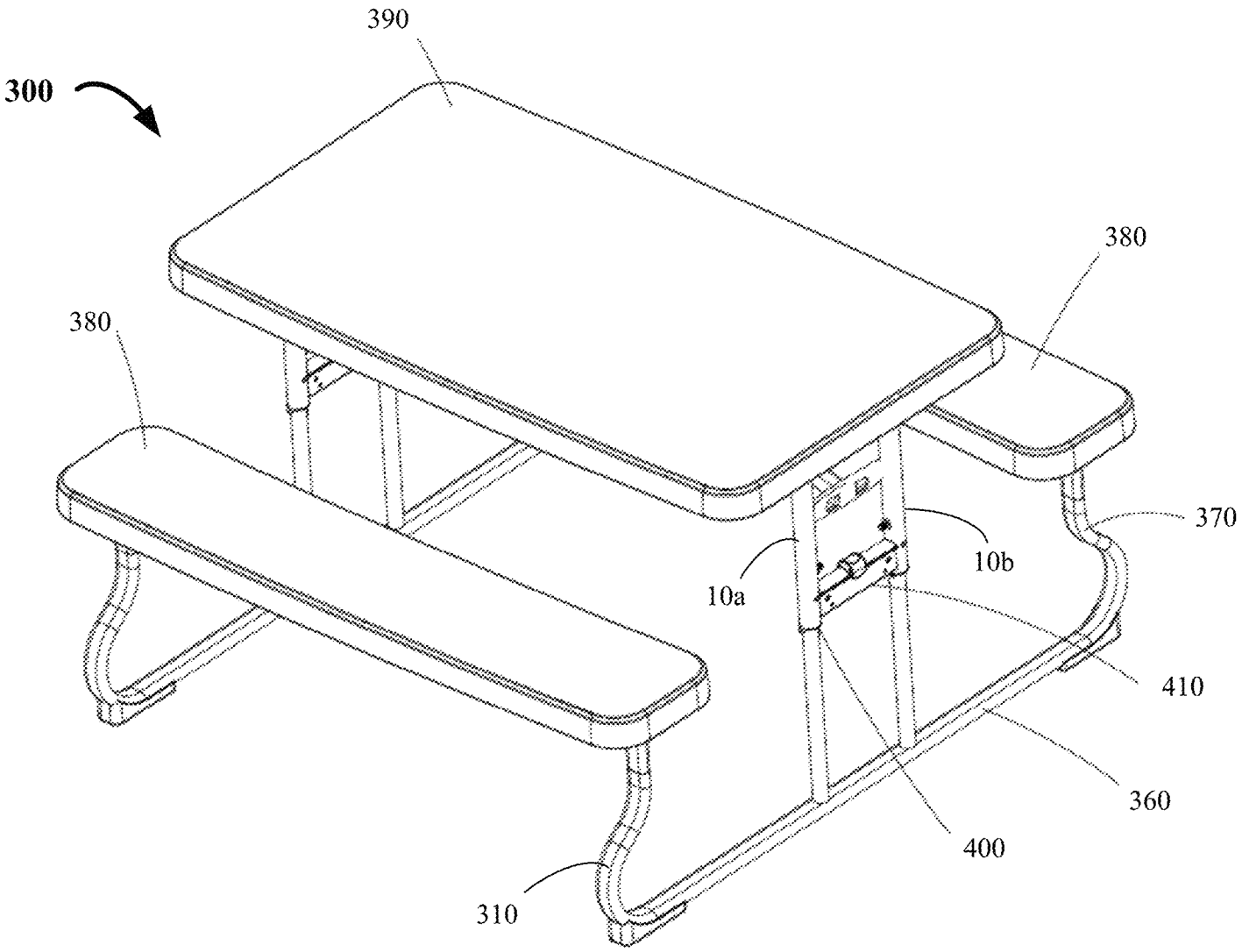
FIG. 6 is a perspective view illustrating an exemplary picnic table in accordance with exemplary embodiments of the present disclosure.

Referring now to FIG. 6, there is depicted an exemplary picnic table in accordance with some embodiments of the present disclosure. As shown, picnic table 300 includes a table panel such as table panel 390 and one or more bench panels such as bench panel 380. Picnic table 300 also includes one or more supporting assemblies such as supporting assembly 310 to support the table and bench panels. In some exemplary embodiments, supporting assembly 310 includes a table support configured to be an adjustable assembly such as adjustable assembly 400 to support the table panel and allow one to adjust the height of the table panel to meet one's need. Supporting assembly 310 also includes one or more bench supports such as bench support 370. For instance, in the illustrated embodiment, supporting assembly 310 includes two bench supports 370, each supporting a corresponding bench panel 380. In an exemplary embodiment, a crossbar such as crossbar 360 is disposed between the two bench supports and integrally formed or connected with the bench supports.

Figure 7:
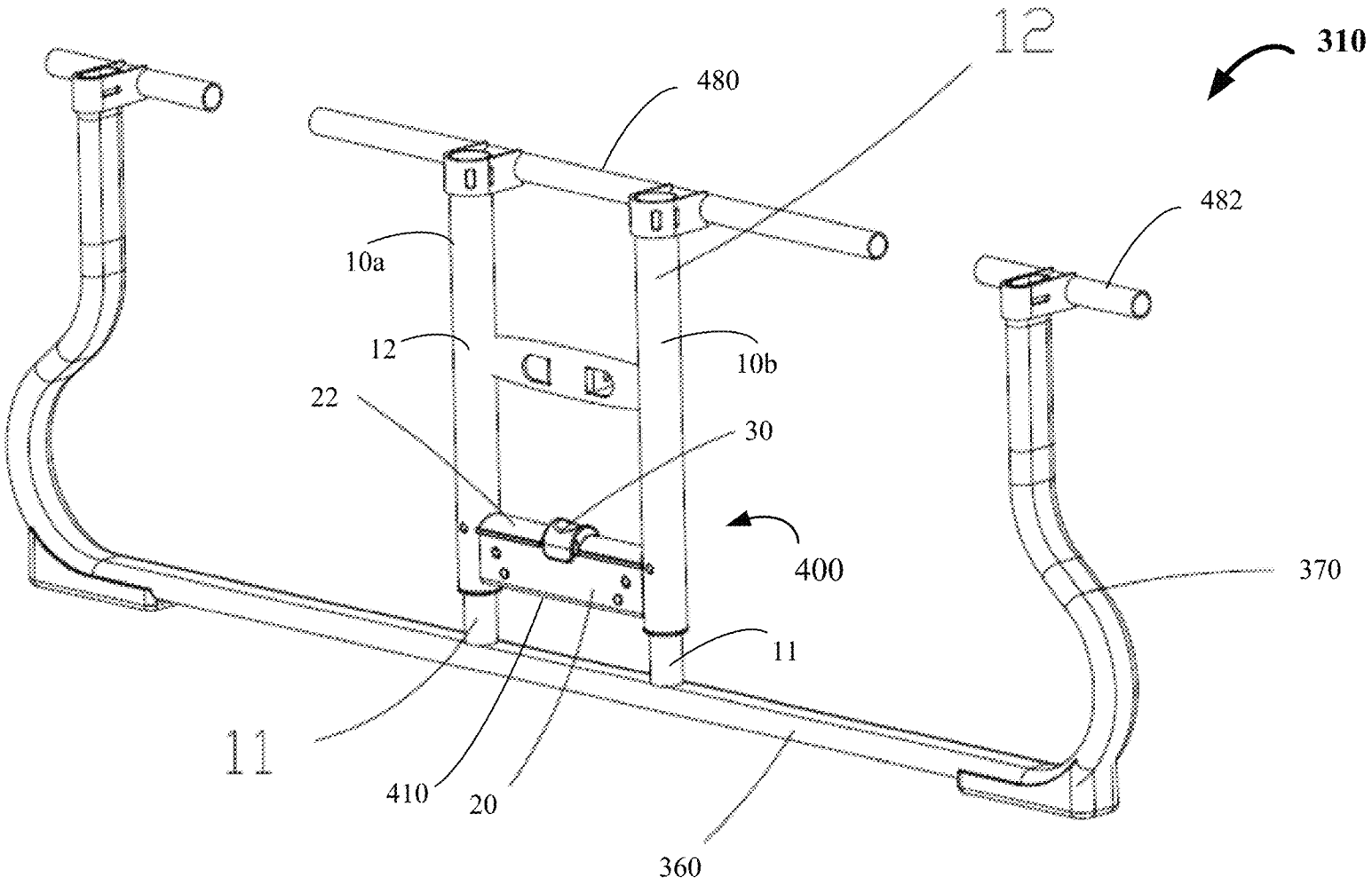
FIG. 7 is a perspective view illustrating an exemplary supporting assembly used in the picnic table of FIG. 6.
Figure 8:
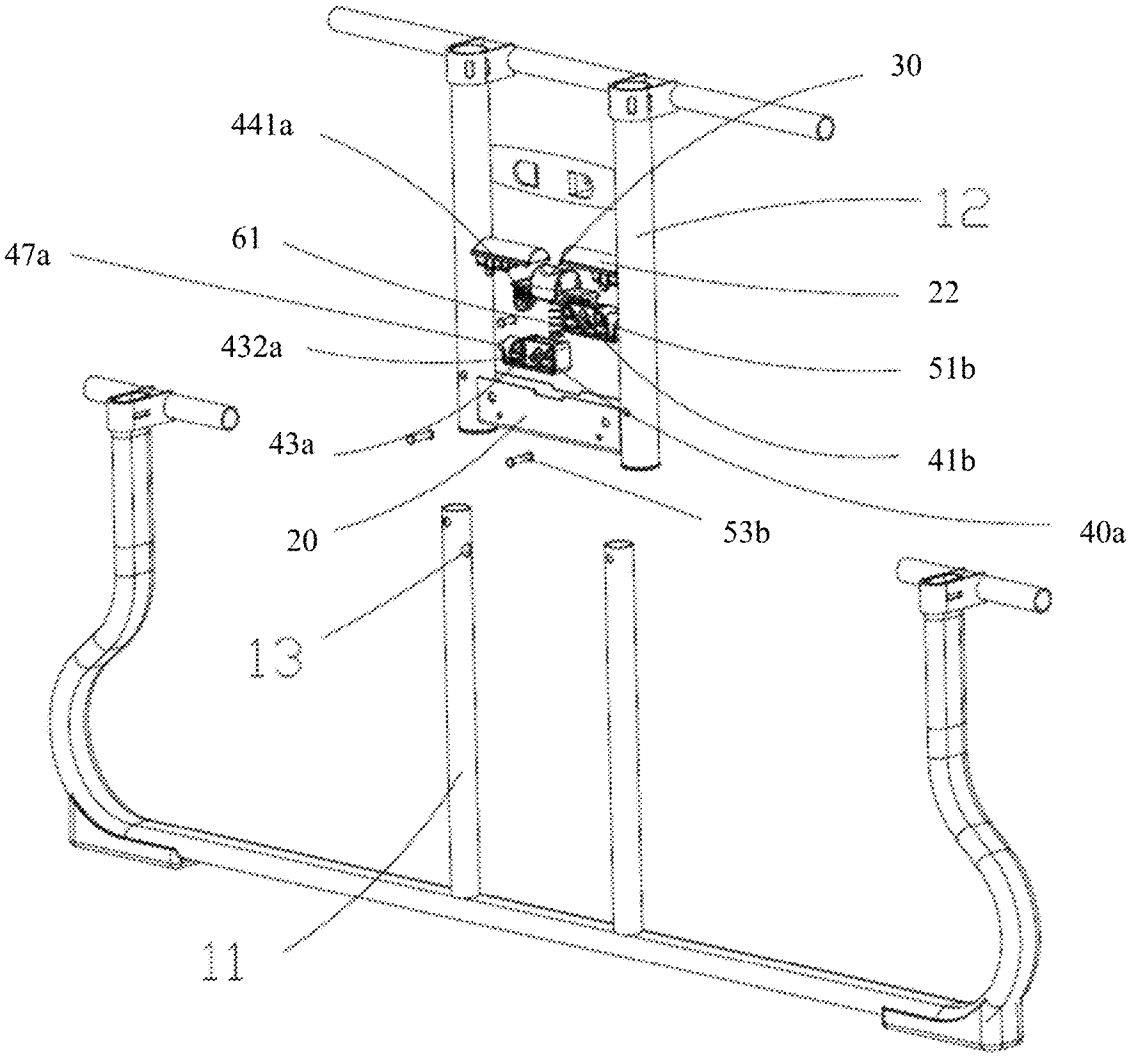
FIG. 8 is a partially disassembled view illustrating the exemplary supporting assembly of FIG. 7.
Figure 8A:
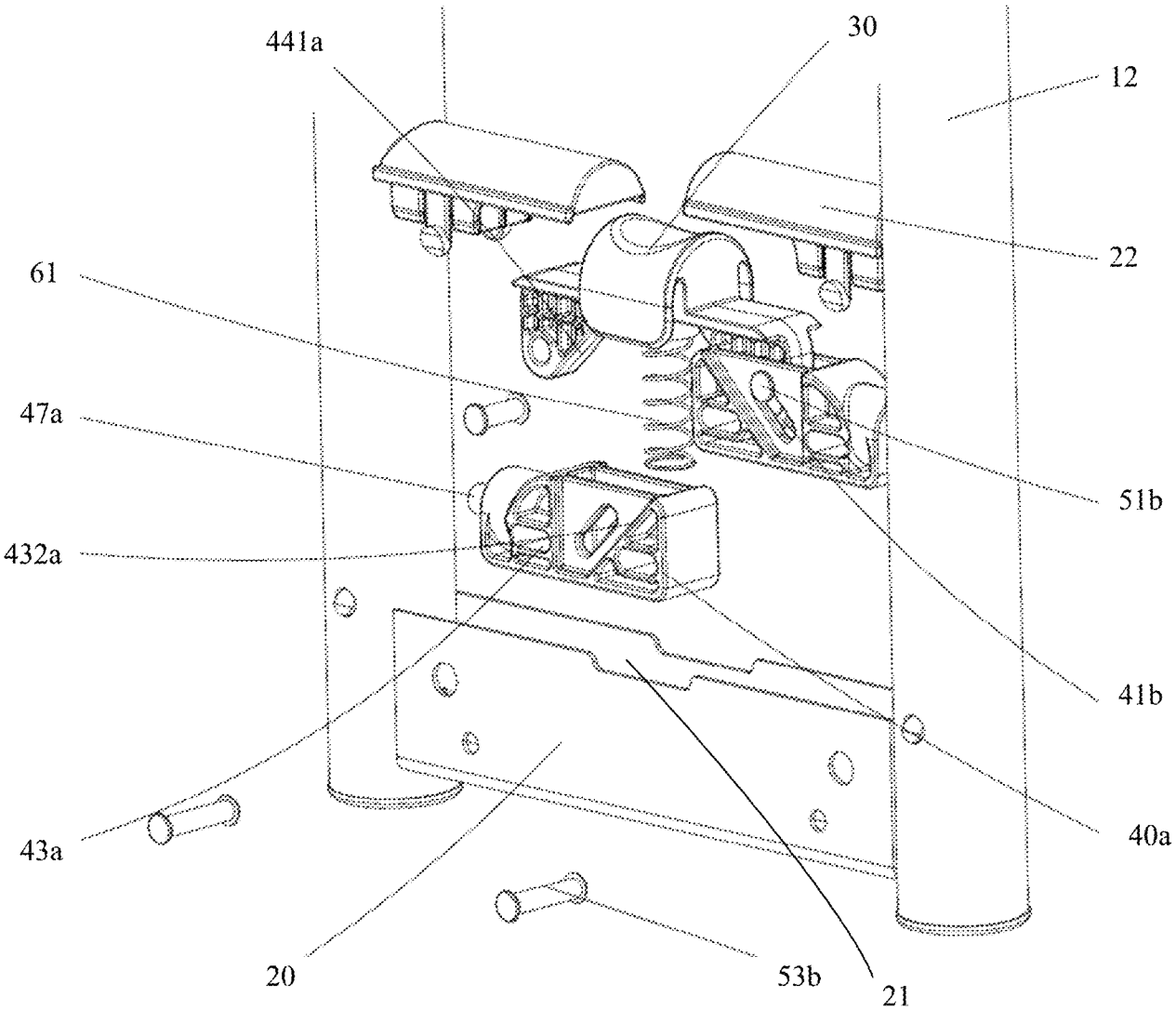
FIG. 8A is a partially enlarged view of FIG. 8 illustrating an exemplary adjustment mechanism in accordance with exemplary embodiments of the present disclosure.
Figure 9:
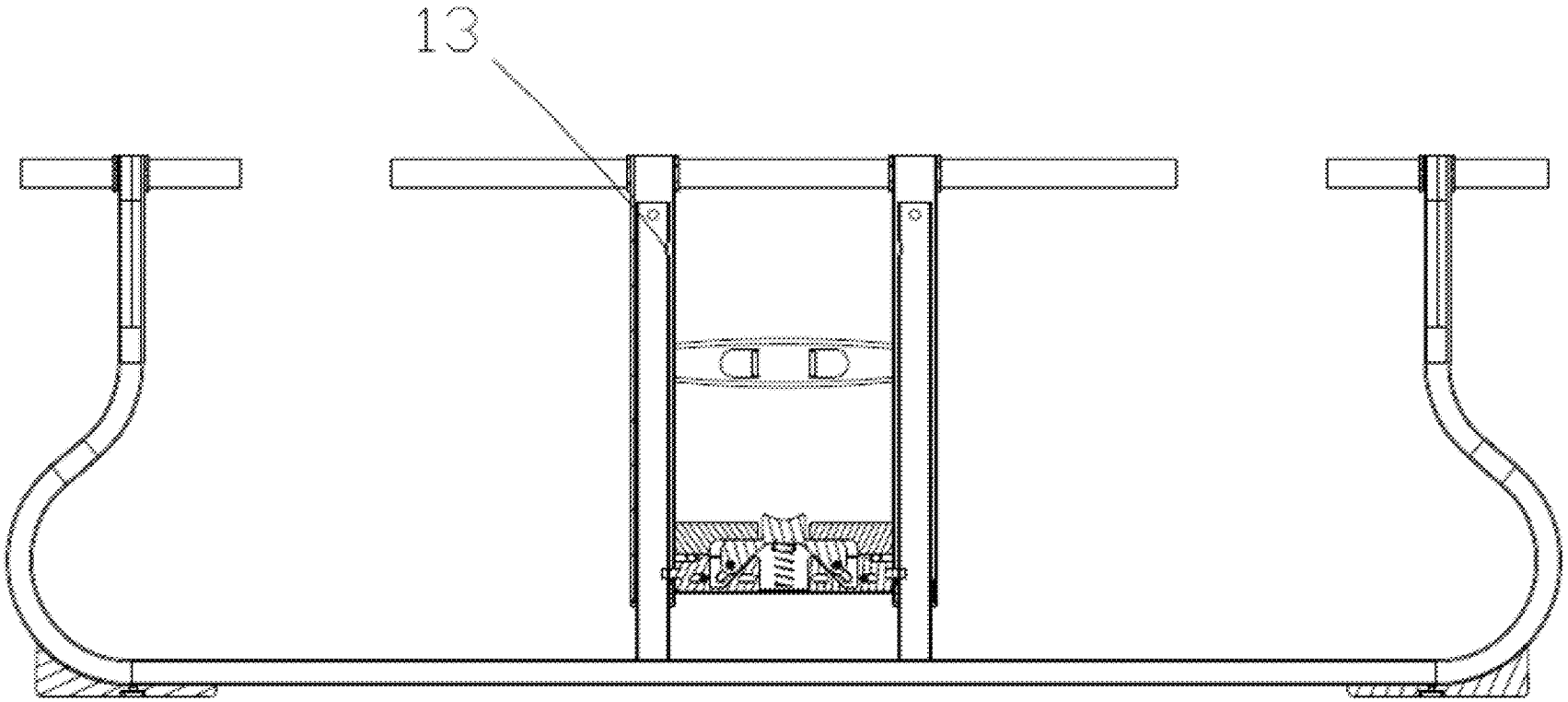
FIG. 9 is a partially cutout side view illustrating the exemplary supporting assembly of FIG. 7.

Referring to FIG. 7, in some exemplary embodiments, adjustable assembly 400 includes a first adjustable support such as first adjustable support 10*a*, a second adjustable support such as second adjustable support 10*b*, and an adjustment mechanism such as adjustment mechanism 410. In an exemplary embodiment, the lower end of adjustable assembly 400 (e.g., the distal ends of inner bars 11 of first adjustable support 10*a* and second adjustable support 10*b*) are connected with crossbar 360.

In some exemplary embodiments, supporting assembly 310 includes one or more additional crossbars. For instance, supporting assembly 310 includes crossbar 480 to couple or support the table panel. In an exemplary embodiment, the upper end of adjustable assembly 400 (e.g., the distal ends of outer tubular bars 12 of first adjustable support 10*a* and second adjustable support 10*b*) are connected with crossbar 380. In some exemplary embodiments, supporting assembly 310 further includes crossbar 482 coupled with bench support 370 and configured to couple or support the bench panel. In some exemplary embodiments, supporting assembly 310 does not include crossbar 480 or crossbar 482, but is coupled to crossbar 480 which severs as a table connecting bar or crossbar 482 which serves as a bench connecting bar.

Referring to FIGS. 7-11, similar to adjustment mechanism 210, adjustment mechanism 410 is disposed between the first and second adjustable supports, having one end coupled with the first adjustable support and a second end coupled with the second adjustable support. The adjustment mechanism is configured to control the relative movement of the inner and outer bars of the first and second adjustable supports, and consequently control the height of the table panel. For instance, in some exemplary embodiments, adjustment mechanism 410 includes a casing such as casing 20, a first arm such as first arm 40*a*, a second arm such as second arm 40*b* and a button such as button 30. The casing includes a first side disposed adjacent to the first adjustable support and a second side disposed adjacent to the second adjustable support. The casing also includes a channel such as channel 21 between the first and second sides of the casing. The first restriction holes of the outer tubular bars of the first and second adjustable supports are accessible through the channel of the casing. In an exemplary embodiment, adjustment mechanism 410 includes a cover such as cover 22 coupled with the casing to encase the first and second arms.

First arm 40*a* and second arm 40*b* are disposed in the channel of the casing. The first arm has a first end such as first end 47*a* adjacent to the first side of the casing, and the second arm has a second end such as second end 47*b* adjacent the second side of the casing. The first and second arms can have any suitable shapes, sizes or the like. In the illustrated embodiments, the first and second arms have a block-like shape each with a pin-like end. The first and second arms are movable with respect to the casing along the first direction (e.g., the x-direction in FIG. 10).

Figure 10:
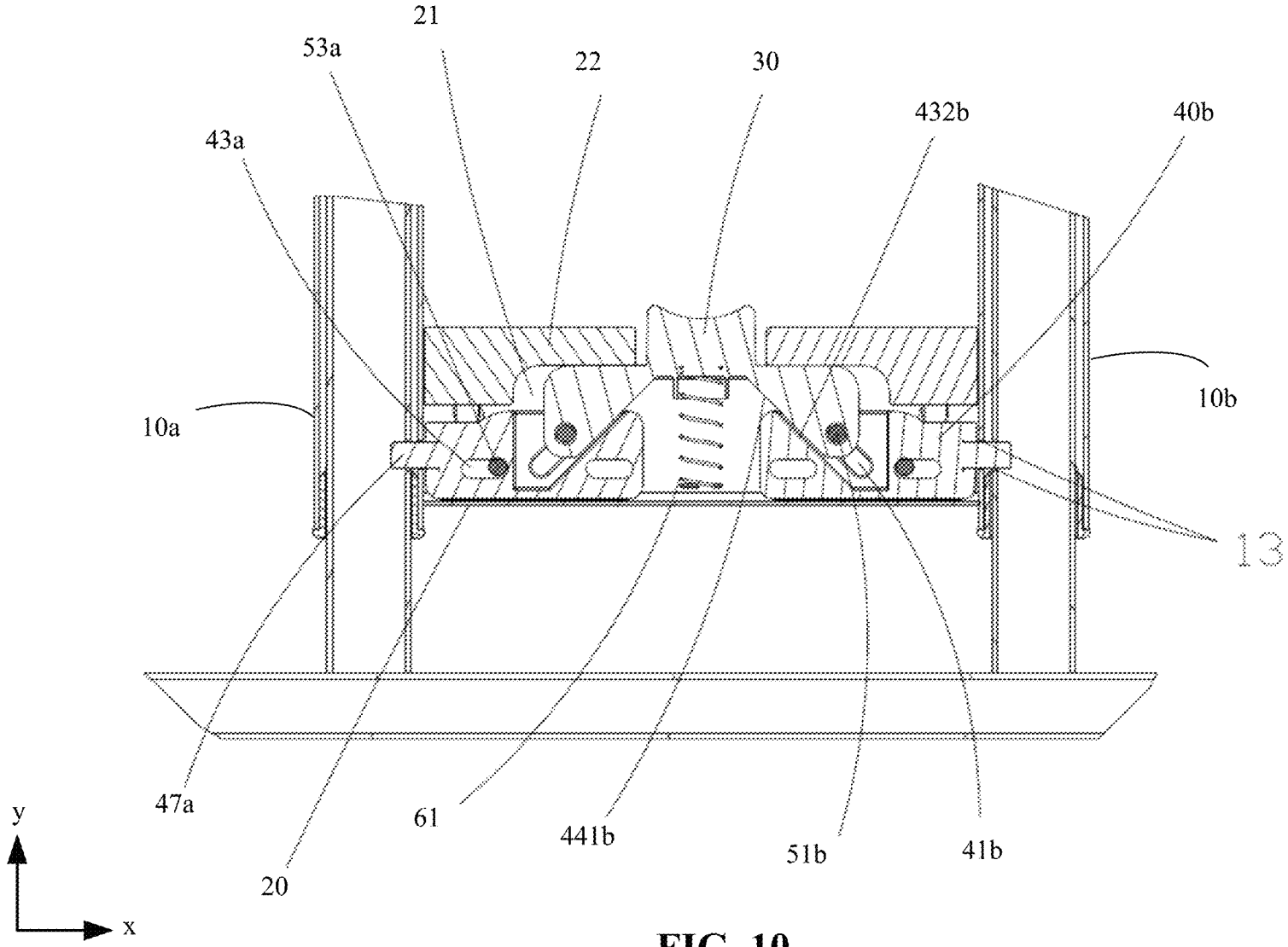
FIG. 10 is a partially enlarged cutout side view illustrating an exemplary adjustment mechanism in a locked state in accordance with exemplary embodiments of the present disclosure.
Figure 11:
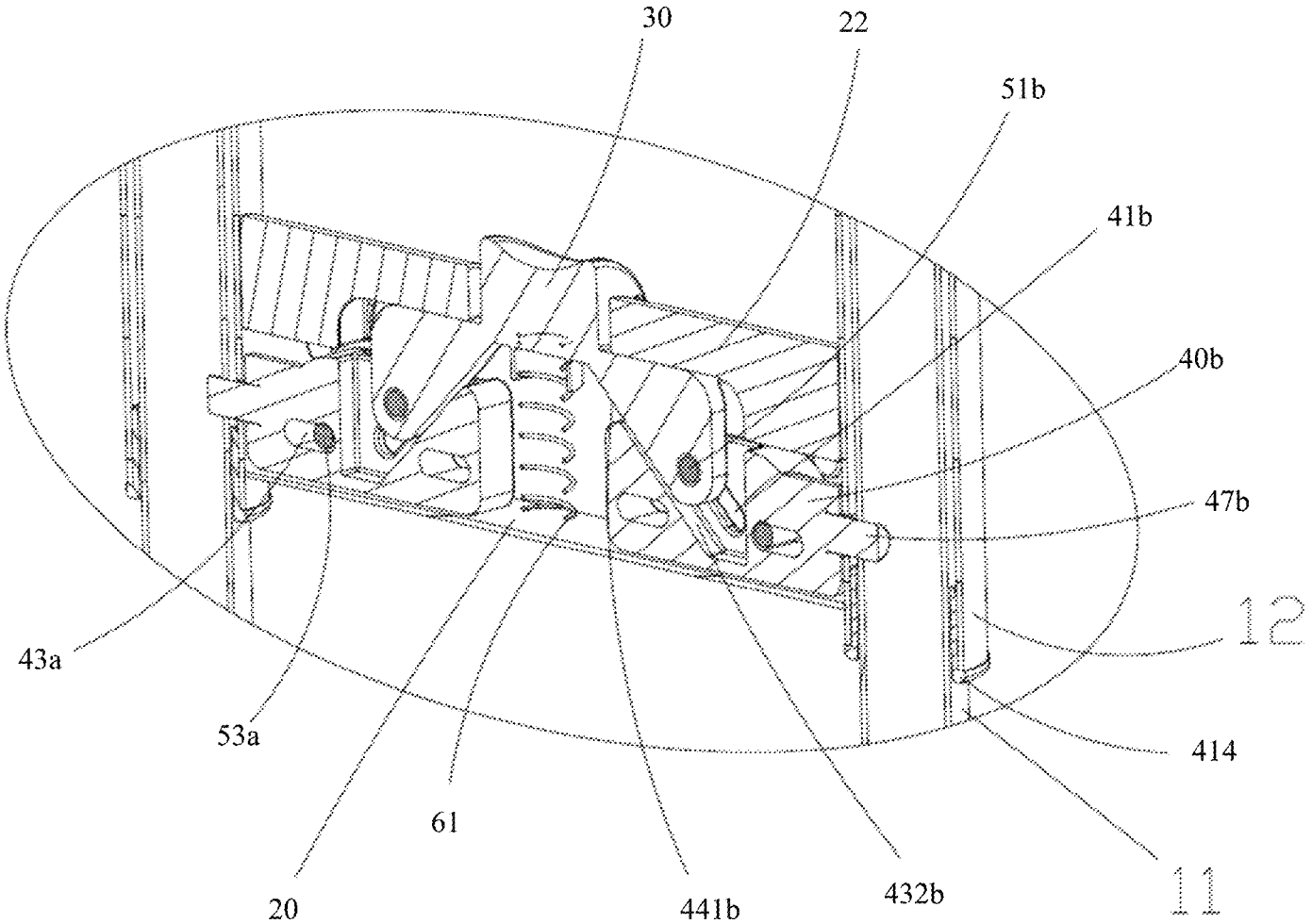
FIG. 11 is a partially enlarged cutout perspective view illustrating an exemplary adjustment mechanism in a locked state in accordance with exemplary embodiments of the present disclosure.
Figure 12:
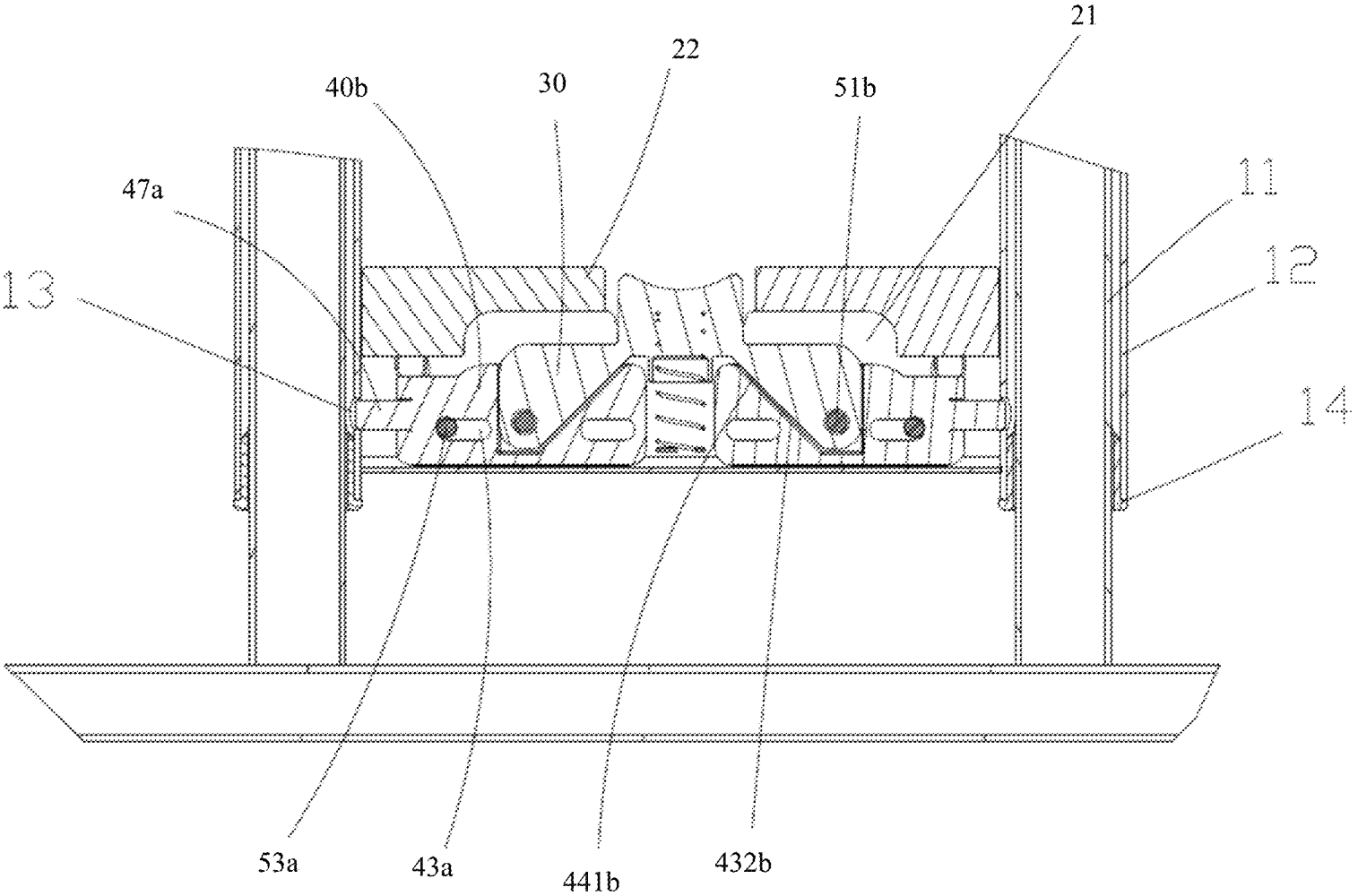
FIG. 12 is a partially enlarged cutout side view illustrating an exemplary adjustment mechanism in an unlocked state in accordance with exemplary embodiments of the present disclosure.

Referring in particular to FIGS. 10 and 12, button 30 is operably coupled with the first and second arms, and is accessible and operable externally, e.g., by a person. The button is movable with respect to the casing along the second direction (e.g., the y-direction in FIG. 10) between a first position and a second position. The first position of the button corresponds to a locking state as illustrated in FIG. 10. As shown, when the button is positioned at the first position, the end of the first or second arm protrudes from the casing and is inserted into the first restriction hole of the outer tubular bar and a restriction member of the inner bar of the respective adjustable support, thereby restricting relative movement of the inner and outer bars in at least one direction. The second position of the button corresponds to an unlocking state as illustrated in FIG. 12. As shown, when the button is positioned at the second position, the end of the first or second arm is disengaged from the inner bar and/or the outer tubular bar, thereby allowing relative movement of the inner and outer bars.

In some exemplary embodiments, to place and keep the button at the first position under normal conditions (e.g., without any external force), the adjustment mechanism includes one or more first elastic members (e.g., string) such as first elastic member 61.

Referring to FIGS. 8A and 10-12, in some exemplary embodiments, the first arm includes a first surface such as surface 432*a* sloped with respect to the first and second directions (e.g., not parallel to either the first or second direction), and the second arm includes a second surface such as surface 432*b* sloped with respect to the first and second directions. In an exemplary embodiment, the first and second surfaces are symmetric with respect to the button. The button includes a third surface such as surface 441*a* and a fourth surface such as surface 441*b* sloped with respect to the first and second directions. The third surface of the button is operably coupled with the first surface of the first arm and the fourth surface of the button is operably coupled with the second surface of the second arm. For instance, in an exemplary embodiment, the third surface of the button is disposed on the first surface of the first arm and the fourth surface of the button is disposed on the second surface of the second arm.

In some exemplary embodiments, similar to adjustment mechanism 210, the first arm of adjustment mechanism 410 includes one or more first slots such as first slot 41*a* and the second arm of adjustment mechanism 410 includes one or more second slots such as second slot 41*b*. Each of the one or more first slots is substantially parallel to the first surface, and each of the one or more second slots is substantially parallel to the second surface. Corresponding to the first and second slots, the button of adjustment mechanism 410 includes one or more first pins such as first pin 51*a* and one or more second pins such as second pin 51*b*. First pin 51*a* is operably coupled with first slot 41*a* and movable along the first slot to guide the movement of the third surface with respect to the first surface of the first arm. Second pin 51*b* is operably coupled with second slot 41*b* and movable along the second slot to guide the movement of the fourth surface with respect to the second surface of the second arm.

In some exemplary embodiments, similar to adjustment mechanism 210, the first arm of adjustment mechanism 410 includes a third slot such as slot 43*a* in the first direction, and casing 20 of adjustment mechanism 410 includes a third pin such as pin 53*a* operably coupled with slot 43*a*. Pin 53*a* is movable along slot 43*a* to guide the movement of the first arm along the first direction. Similarly, second arm 40*b* of adjustment mechanism 410 includes a fourth slot such as fourth slot 43*b* in the first direction, and casing 20 of adjustment mechanism 410 includes a fourth pin such as pin 53*b* operably coupled with the fourth slot. The fourth pin is movable along the fourth slot to guide the movement of the second arm along the first direction.

As the button moves from the first position as illustrated in FIG. 10 to the second position as illustrated in FIG. 12, surface 441*a* of the button, alone or together with pin 51*a* and slot 41*a*, pushes the first arm toward the second arm (away from the first adjustable support) and thus pulls the first end of the first arm out of the restriction member of the inner bar and/or the first restriction hole of the outer tubular bar of the first adjustable support. Similarly, surface 441*b* of the button, alone or together with pin 51*b* and slot 41*b*, pushes the second arm toward the first arm (away from the second adjustable support) and thus pulls the second end of the second arm out of the restriction member of the inner bar and/or the first restriction hole of the outer tubular bar of the second adjustable support. At this state, the inner bar of the respective adjustable support is movable with respect to the outer tubular bar of the respective adjustable support in both directions, e.g., toward or away from the outer tubular bar.

As the button moves upward from the second position to the first position, pins 51*a* and 51*b* move upward as well. Because slots 41*a* and 41*b* are sloped and because the first and second arms are movable in the first direction, the upward movement of the pins pushes the first arm toward the first adjustable support and the second arm toward the second adjustable support. As a result, the first end of the first arm protrudes from the first side of the casing and into the first restriction hole of the outer tubular bar and the restriction member of the inner bar of the first adjustable support, and the second end of the second arm protrudes from the second side of the casing and into the first restriction hole of the outer tubular bar and the restriction member of the inner bar of the second adjustable support. In this state, depending on the configuration of the restriction member of the inner bar, the inner bar is restricted from moving with respect to the outer tubular bar of the respective adjustable support in at least one direction.

The picnic tables of the present disclosures have several advantages. For instance, the picnic table can be folded into a general panel-like shape, with the table and bench panels aligned with each other and the supporting assemblies folded onto the table and beach panels. As such, the picnic table is portable and easy to carry around. When in use, the height of the table panel can be adjusted to meet the needs and preferences of various end users. The adjustment is simple and easy with the table supports disclosed herein. In embodiments where the inner bars of the adjustable supports have one-way restriction structures, the height of the table panel can be increased by simply lifting the side bars or the table panel. In addition, with the sliders, rails and links disclosed herein, folding and unfolding of the supporting assemblies are smooth and fast.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A picnic table comprising:

a table panel;

one or more bench panels;

first and second supporting assemblies, each operable between a use position and a storage position, wherein when in the use position, the first supporting assembly is disposed at a first side of the picnic table and the second supporting assembly is disposed at a second side of the picnic table, wherein each of the first and second supporting assemblies comprises a table support and one or more bench supports;

a table frame disposed at a bottom side of the table panel and configured to connect the table supports of the first and second supporting assemblies with the table panel such that the table support of each of the first and second supporting assemblies is rotatable with respect to the table panel; and one or more bench frames, each disposed at a bottom side of a corresponding bench panel in the one or more bench panels and configured to connect a respective bench support in the one or more bench supports of the first supporting assembly and a respective bench support in the one or more bench supports of the second supporting assembly with the corresponding bench panel such that the respective bench supporting assembly of each of the first and second supporting assemblies is rotatable with respect to the corresponding bench panel, wherein:

the table support of each of the first and second supporting assemblies comprises one or more adjustable supports each having an adjustable length, wherein when each of the first and second supporting assemblies is in the use position, adjusting collectively the lengths of the one or more adjustable supports of the table supports of the first and second supporting assemblies changes a height of the table panel with respect to the one or more bench panels;

the table frame comprises:

a first table side bar coupled with a first side of the table panel;

a second table side bar coupled with a second side of the table panel; and a table connecting bar corresponding to each respective supporting assembly in the first and second supporting assemblies, the table connecting bar comprising:

a first end portion pivotally connected with the first table side bar;

a second end portion pivotally connected with the second table side bar; and a middle portion between the first and second end portions, wherein the one or more adjustable supports of the respective table support is connected with the table connecting bar; and corresponding to each respective supporting assembly in the first and second supporting assemblies, the table frame further comprises:

a rail disposed between the first and second table side bars and extended in a direction substantially the same as the first and second table side bars;

a slider slidably coupled with the rail such that the slider is movable along the rail in a length direction of the rail and the slider comprising a control mechanism to selectively lock the slider with the rail to prevent the slider from moving along the rail and unlock the slider with the rail to allow the slider to move along the rail; and a link having a first end portion pivotally coupled with the slider and a second end portion pivotally coupled with the one or more adjustable supports.

2. The picnic table of claim 1, wherein each of the first and second supporting assemblies further comprises a crossbar connecting the table support and the one or more bench supports.

3. The picnic table of claim 1, wherein each of the one or more adjustable supports of the table support comprises an inner bar and an outer bar telescopically coupled with each other.

4. The picnic table of claim 3, wherein the table support further comprises an adjustment mechanism coupled with the one or more adjustable supports and configured to control relative movement of the inner and outer bars of each of the one or more adjustable supports.

5. The picnic table of claim 3, wherein each of the one or more adjustable supports comprises a locking/unlocking mechanism configured to control relative movement of the inner and outer bars of the respective adjustable support.

6. The picnic table of claim 1, wherein the table connecting bar is curved or bended, wherein the first and second end portions are aligned with each other and the middle portion is offset with respect to the first and second end portions.

7. The picnic table of claim 1, wherein corresponding to each respective supporting assembly in the first and second supporting assemblies, the table frame further comprises:

a reinforcement bar having a first end portion connected with the first table side bar and a second end portion connected with the second table side bar, wherein the rail is connected with the middle portion of the connecting bar and a middle portion of the reinforcement bar.

8. The picnic table of claim 1, wherein the rail corresponding to the first supporting assembly and the rail corresponding to the second supporting assembly are integrally formed as a unitary piece.

9. The picnic table of claim 1, wherein each of the one or more bench frames comprises:

a first bench side bar coupled with a first side of the corresponding bench panel;

a second bench side bar coupled with a second side of the bench panel; and a bench connecting bar corresponding to each respective supporting assembly in the first and second supporting assemblies and comprising a first end portion pivotally connected with the first bench side bar and a second end portion pivotally connected with the second bench side bar, wherein the bench connecting bar is aligned with the first and second end portions of the table connecting bar, and the respective bench support in the one or more bench supports of the respective table support is connected with the bench connecting bar.

10. The picnic table of claim 1, wherein the height of the table panel is adjustable between a first position at which the table panel is positioned higher than the one or more bench panels and a second position at which the table panel is positioned at a level substantially the same as the one or more bench panels.

11. A supporting frame comprising:

first and second supporting assemblies, each comprising a crossbar, a table support connected with the crossbar, and one or more bench supports each connected or formed with the crossbar;

a table frame configured to connect the table supports of the first and second supporting assemblies with a table panel such that the table support of each of the first and second supporting assemblies is rotatable with respect to the table panel; and one or more bench frames, each configured to connect a respective bench support in the one or more bench supports of the first supporting assembly and a respective bench support in the one or more bench supports of the second supporting assembly with a corresponding bench panel in one or more bench panels such that the respective bench supporting assembly of each of the first and second supporting assemblies is rotatable with respect to the corresponding bench panel, wherein:

the table support of each of the first and second supporting assemblies comprises one or more adjustable supports each having an adjustable length wherein when each of the first and second supporting assemblies is in a use position, adjusting collectively the lengths of the one or more adjustable supports of the table supports of the first and second supporting assemblies changes a height of the table panel with respect to the one or more bench panels;

the table frame comprises:

a first table side bar coupled with a first side of the table panel;

a second table side bar coupled with a second side of the table panel; and a table connecting bar corresponding to each respective supporting assembly in the first and second supporting assemblies, the table connecting bar comprising:

a first end portion pivotally connected with the first table side bar;

a second end portion pivotally connected with the second table side bar; and a middle portion between the first and second end portions, wherein the one or more adjustable supports of the respective table support is connected with the table connecting bar; and the table connecting bar is curved or bended, wherein the first and second end portions are aligned with each other and the middle portion is offset with respect to the first and second end portions.

12. A picnic table comprising the supporting assembly of claim 11.

13. A supporting frame comprising:

first and second supporting assemblies, each comprising a crossbar, a table support connected with the crossbar, and one or more bench supports each connected or formed with the crossbar;

a table frame configured to connect the table supports of the first and second supporting assemblies with a table panel such that the table support of each of the first and second supporting assemblies is rotatable with respect to the table panel; and one or more bench frames, each configured to connect a respective bench support in the one or more bench supports of the first supporting assembly and a respective bench support in the one or more bench supports of the second supporting assembly with a corresponding bench panel in one or more bench panels such that the respective bench supporting assembly of each of the first and second supporting assemblies is rotatable with respect to the corresponding bench panel, wherein:

the table support of each of the first and second supporting assemblies comprises one or more adjustable supports each having an adjustable length wherein when each of the first and second supporting assemblies is in a use position, adjusting collectively the lengths of the one or more adjustable supports of the table supports of the first and second supporting assemblies changes a height of the table panel with respect to the one or more bench panels;

the table frame comprises:

a first table side bar coupled with a first side of the table panel;

a second table side bar coupled with a second side of the table panel; and a table connecting bar corresponding to each respective supporting assembly in the first and second supporting assemblies, the table connecting bar comprising:

a first end portion pivotally connected with the first table side bar;

a second end portion pivotally connected with the second table side bar; and a middle portion between the first and second end portions, wherein the one or more adjustable supports of the respective table support is connected with the table connecting bar; and corresponding to each respective supporting assembly in the first and second supporting assemblies, the table frame further comprises:

a rail disposed between the first and second table side bars and extended in a direction substantially the same as the first and second table side bars;

a slider slidably coupled with the rail such that the slider is movable along the rail in a length direction of the rail and the slider comprising a control mechanism to selectively lock the slider with the rail to prevent the slider from moving along the rail and unlock the slider with the rail to allow the slider to move along the rail; and a link having a first end portion pivotally coupled with the slider and a second end portion pivotally coupled with the one or more adjustable supports.

14. The supporting frame of claim 13, wherein the table support further comprises an adjustment mechanism coupled with the one or more adjustable supports to control relative movement of the inner and outer bars of the one or more adjustable supports.

15. The supporting frame of claim 13, wherein each of the one or more adjustable supports comprises a locking/unlocking mechanism configured to control relative movement of the inner and outer bars of the respective adjustable support.

16. The supporting frame of claim 13, wherein corresponding to each respective supporting assembly in the first and second supporting assemblies, the table frame further comprises:

a reinforcement bar having a first end portion connected with the first table side bar and a second end portion connected with the second table side bar, wherein the rail is connected with the middle portion of the table connecting bar and a middle portion of the reinforcement bar.

* * * * *